United States Patent [19]

Hernqvist

[11] 4,431,939

[45] Feb. 14, 1984

[54] STRUCTURE AND METHOD FOR ELIMINATING BLOCKED APERTURES CAUSED BY CHARGED PARTICLES

[75] Inventor: Karl G. Hernqvist, Princeton, N.J.

[73] Assignee: RCA Corporation, New York, N.Y.

[21] Appl. No.: 287,562

[22] Filed: Jul. 28, 1981

[51] Int. Cl.[3] ..... H01J 29/07; H01J 29/94; F01J 9/20

[52] U.S. Cl. ..... 313/402; 313/481; 455/2; 455/55

[58] Field of Search ..... 313/481, 402; 445/2, 445/55, 11, 14

[56] References Cited

U.S. PATENT DOCUMENTS

| | | | |
|---|---|---|---|
| 3,131,983 | 5/1964 | Harries | 316/25 |
| 3,329,853 | 7/1967 | Neuhauser | 313/179 |
| 3,387,908 | 6/1968 | Fogelson | 445/55 |
| 3,508,105 | 4/1970 | Pappadis | 313/481 |
| 3,711,734 | 1/1973 | Yamazaki et al. | 313/481 |
| 3,712,699 | 1/1973 | Syster | 316/2 |
| 3,781,076 | 12/1973 | Dietch et al. | 445/2 |
| 3,792,300 | 2/1974 | Benda et al. | 313/85 R |
| 4,006,381 | 2/1977 | Thall | 313/481 |
| 4,398,897 | 8/1983 | Nubani et al. | 445/5 |

FOREIGN PATENT DOCUMENTS

| | | |
|---|---|---|
| 682555 | 11/1952 | United Kingdom . |
| 682556 | 11/1952 | United Kingdom . |
| 1041356 | 9/1966 | United Kingdom . |
| 1142661 | 2/1969 | United Kingdom . |
| 1194357 | 6/1970 | United Kingdom . |
| 1476339 | 6/1977 | United Kingdom . |
| 1534169 | 11/1978 | United Kingdom . |

*Primary Examiner*—Palmer C. Demeo

*Attorney, Agent, or Firm*—Eugene M. Whitacre; Dennis H. Irlbeck; Vincent J. Coughlin, Jr.

[57] ABSTRACT

A structure and method is proposed for eliminating so-called halo-blocked apertures in color picture tubes. The halo-blocked apertures are caused by insulative negatively-charged particles attached to the gas-sorbing conductive getter metal film on the inside surface of the shadow mask which deflect the transmitting portions of an electron beam. The structure comprises a source within the tube for depositing a gas-sorbing conductive getter metal overlay on the charged particle to render the particle conductive so that the particle cannot deflect the beam.

5 Claims, 6 Drawing Figures

STRUCTURE AND METHOD FOR ELIMINATING BLOCKED APERTURES CAUSED BY CHARGED PARTICLES

BACKGROUND OF THE INVENTION

This invention relates to a novel structure and method for eliminating blocked apertures caused by charged particles on a shadow mask of a color television picture tube and more particularly to a structure and method for salvaging color picture tubes in which charged particles attached to the beam intercepting interior surface of the shadow mask are rendered conductive so as not to deflect the transmitting portions of the electron beams from the proper apertures in the shadow mask.

During the manufacturing and handling of a color television picture tube, both conductive and nonconductive particles may be trapped or generated within the tube. Typical rejection rates due to such particles average about ½ of 1 percent for new tubes and as high as 5 to 10 percent for reworked tubes. Conductive particles include carbonized fibers, soot, aluminum flakes and weld splash. Nonconductive or insulative particles usually comprise glass and phosphor. Glass particles may be introduced into the tube during the reworking of tubes when the tubes are renecked, or the glass particles may be generated inside both new or reworked tubes, for example, from cracked stem fillets, or mechanical damage from the friction of the bulb spacer snubbers against the glass during gun insertion. Glass particles can also be generated by crazing of the neck glass and the glass support beads during high voltage processing or from electron bombardment of the glass.

Conductive particles cause picture imperfections asuch as dark spots on the screen if the particles physically block the apertures in the shadow mask. The spots or shadows from conductive particles blocking the shadow mask apertures will appear on the screen to be approximately the same size as the particles in the mask apertures.

On the other hand, insulative particles which are charged negatively by the electron beams will cause deflection of the beams by coulomb repulsion. Therefore, these particles can cause picture imperfections such as screen spots when attached to the mask without physically blocking the mask apertures. Furthermore, it has been observed that the insulative particles, in addition to causing screen spots, also cause color misregister of the electron beams. The color misregister creates a "halo" effect resulting from the electron beams being deflected and striking the phosphor elements surrounding the obscured region.

An apparatus for removing charged particles from a conductive element, such as a shadow mask, of a color picture tube is described in U.S. Pat. No. 3,712,699 issued on Jan. 23, 1973 to Syster. The apparatus requires that the vacuum integrity of the tube be interrupted by removing the neck portion of the tube. As pointed out herein, the renecking or rework operation is a major cause of particle scrap so the apparatus disclosed in the Syster patent is only a partial solution to the problem. Furthermore, after the cleaning and rebuilding procedure disclosed in the Syster patent, the tube must be reprocessed. During reprocessing (exhaust, spot knocking, high voltage aging, etc.), additional particles may be generated.

Thus a structure and procedure is required by which the vacuum integrity of the tube is maintained, but the most troublesome particles, i.e., the nonconductive charged particles affixed to the beam intercepting interior surface of the shadow mask are "eliminated" by rendering them conductive.

SUMMARY OF THE INVENTION

An improved cathode-ray tube comprises an evacuated envelope, having within the envelope a luminescent viewing screen, means for producing at least one electron beam for exciting the screen to luminescence and an apertured mask closely spaced from said screen for selectively intercepting and transmitting portions of said electron beam. Gettering means are provided for coating the mask with a gas-sorbing, conductive getter material film. The improvement comprises source means within the tube for depositing a gas-sorbing conductive getter material overlay on a negatively-charged particle which is attached to the getter metal film on the mask. The overlay renders the particle conductive so that transmitting portions of the electron beam are not deflected by the particle.

DESCRIPTION OF THE PREFERRED EMBODIMENT

Figure 1:
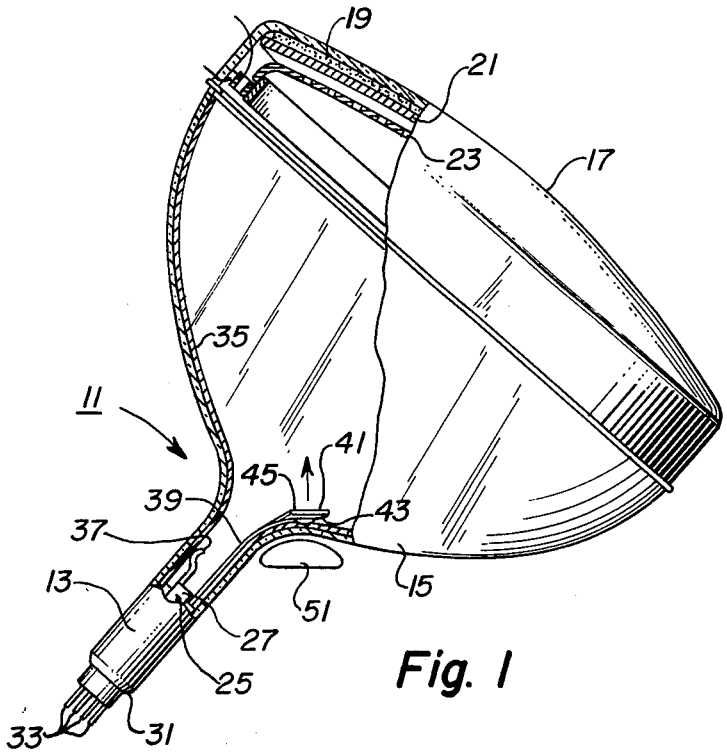
FIG. 1 is a partially broken-away longitudinal view of a cathode-ray tube utilizing the invention.

The cathode-ray tube illustrated in FIG. 1 is an apertured-mask-type color television picture tube. The tube comprises an evacuated envelope 11 including a cylindrical neck 13 extending from the small end of a funnel 15. The large end of the funnel 15 is closed by a faceplate panel 17. A luminescent tricolor mosaic screen 19, which is backed by a reflecting metal layer 21 of aluminum metal, is supported on the inner surface of the panel 17. The screen comprises a multiplicity of trios, each comprising a green-emitting, a red-emitting and a blue-emitting element. A shadow mask 23 is supported within the envelope close to the screen to achieve color selection. The mask is a metal sheet having an array of apertures therethrough which are systematically related to the trios of the screen 19. An electron gun mount assembly 25 comprising an array of three similar electron guns for generating three electron beams is mounted in the neck 13. The mount assembly includes a convergence cup 27, which is that element of the mount assembly closest to the screen 19. The end of the neck 13 is closed by a stem 31 having terminal pins or leads 33 on which the mount assembly 25 is supported and through which electrical connections are made to various elements of the mount assembly 25.

An opaque, conductive funnel coating 35 comprising graphite, iron oxide and a silicate binder on the inner surface of the funnel 15 is electrically connected to the high-voltage terminal or anode button (not shown) in the funnel 15. Three bulb spacers 37 are welded to and connect the convergence cup 27 with the funnel coating 35. The bulb spacers 37, which are preferably made of spring steel, also center and position the extended end of the mount assembly 25 with the longitudinal axis of the tube.

A getter assembly comprises an elongated spring 39, which is attached at one end to the cup 27 of the mount assembly 25 and extends in cantilever fashion onto the funnel 15. A metal getter container 41 is attached to the other extended end of the spring 39, and a sled including two curved runners 43 is attached to the bottom of the container 41. The container has a ring-shaped channel containing getter material 45 with a closed base facing the inner wall of the funnel 15. The spring 39 is a ribbon of metal which urges the base of the container 41 outwardly toward the funnel wall with the runners 43 contacting the coating 35. The length of the spring 39 permits the container 41 to be positioned well within the funnel 15, where the getter material can be flashed (vaporized) to provide optimum coverage and where the spring 39 and container 41 will be out of the paths of the electron beams issuing from the mount assembly 25 and not interfere with the operation of the tube.

As shown in FIG. 1, the tube is assembled and the envelope has been evacuated of gases and hermetically sealed. This may be achieved by any of the known fabrication and assembly processes. However, the getter material has not been vaporized in the getter container 41. In this embodiment, the getter container 41 holds a mixture of nickel and a barium-aluminum alloy, which upon heating reacts exothermically, vaporizes barium metal and leaves a residue of an aluminum-nickel alloy and barium metal in the container 41.

Figure 2:
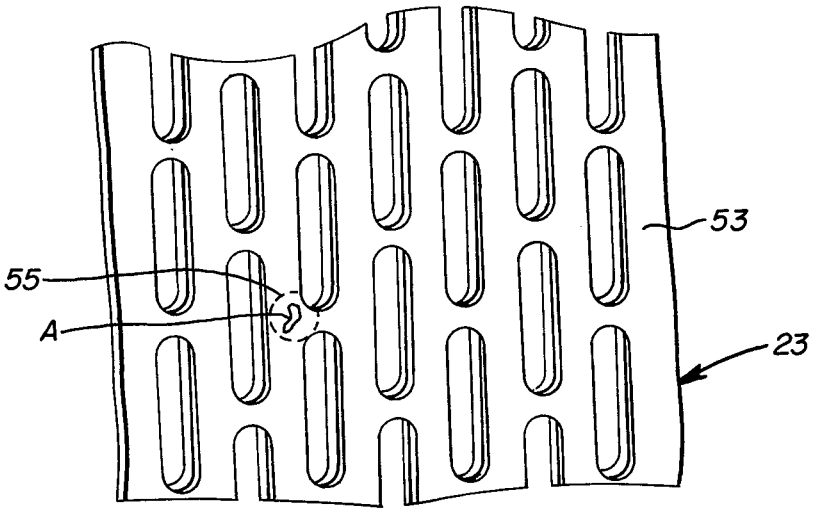
FIG. 2 is an enlarged fragmentary view of a shadow mask.

To "flash" the getter; that is, to cause the exothermic reaction to take place, use is made of an induction heating coil 51. The induction coil 51, by induction, will heat the getter container 41 and its contents 45 until the contents flash releasing barium vapor. As shown in FIG. 2, the barium vapor deposits as a gas-sorbing barium metal layer 53, principally on the interior surface of the mask 23 and also on a portion of the funnel coating 35. The total amount of available barium metal contained in the above-described getter container 41 is about 265 milligrams (mg); however, the exothermic reaction releases only about 180 mg of barium. To ensure a sufficient quantity of barium for gettering purposes, it is common practice to continue to inductively heat the getter container 41 for an additional 30 seconds following the flash to endothermically release about another 10 to 20 mg of barium for a total barium getter flash of between 190 to 200 mg.

During the subsequent tube processing and testing steps, including cathode discharge ball gap (CDBG), cathode conversion, hot shot, first low voltage age, initial test, implosion proofing, external coating, frit breakdown check, radio frequency spot knock (RFSK), final low voltage age and final test, the tube is handled extensively and exposed to high voltages which may either mechanically or electrically transport particles to the shadow mask 23. While conductive particles can often be removed from the mask by externally-controlled means, such as mechanical vibration, heating the mask with an AC magnetic field and mechanically moving a free magnetic object on the inside of the mask controlled by an external magnet, such methods are of little use in dislodging insulative particles, such as glass. Glass particles may be strongly bound to the mask because of electrostatic charge interaction or anodic bonding between the insulating particle and the mask. Anodic bonding is assumed to be caused by interdiffusion of atoms at the interface between the glass and metal as a result of the applied electric field. Anodic bonding and the resulting glass-to-metal adhesion force can be affected by surface treatment of the components. Thus, the film of barium metal 53 covering the mask 23 after getter flash may contribute to the adhesion of the glass particles by providing a smooth, clean conductive metal surface which facilitates adhesion.

As discussed above in the background of the invention, the insulative particles adhering to the shadow mask 23 become negatively charged by the electron beams and deflect the transmitting portions of the electron beam from the proper mask aperture causing an apparent "blocked aperture" in the shadow mask and a resultant dark spot surrounded by halo (hereinafter called a halo-blocked aperture) to appear on the screen. Experiments have shown that tubes "salted" with glass particles exhibit literally hundreds of halo-blocked apertures. Since it is impossible to remove the glass and other insulative particles from the tube without interrupting the vacuum integrity of the envelope, applicant has devised a novel salvage procedure for rendering the insulative particles on the shadow mask conductive and thereby preventing the deflection of the transmitting portions of the electron beams by negatively-charged particles.

As shown in FIG. 2, an insulative particle A, for example, of glass, is attached to the barium film 53 on the inside surface (i.e., facing the electron gun mount assembly 25) of the shadow mask 23. One method of rendering the particle conductive is to scan the electron beam in a circle, indicated by the dotted path 55, around the particle. The electron beam will heat the mask sufficiently to evaporate some barium from the barium film 53 onto the particle A, thereby forming a conductive overlay on the particle. Care must be taken in this process not to burn the phosphor screen. This process may be impractical in tubes having a large number of halo-blocked apertures.

A more practical method of eliminating halo-blocked apertures is to reactivate or "reflash" the getter on those tubes having halo-blocked apertures at initial test. Since the getter container 41 has a barium metal residue remaining after the initial exothermic getter flash, the barium may be endothermically released from the container 41 and deposited as an overlay on the charged particle on the mask 23 by inductively heating the container 41 for a period of time sufficient to evaporate barium metal. A small quantity of barium is sufficient to render the insulative particles adhering to film 53 on the mask 23 conductive. Tubes having the getter container 41 "reflashed" by the above-described method may be immediately retested for halo-blocked apertures and returned to the next step in the processing cycle without undo disruption of the flow of product. The same procedure described above may also be utilized after final test if halo-blocked apertures are encountered at that point in the process. Of course, the number of times this salvage procedure can be used is limited by the amount of available barium metal residue in the getter container 41.

Figure 3:
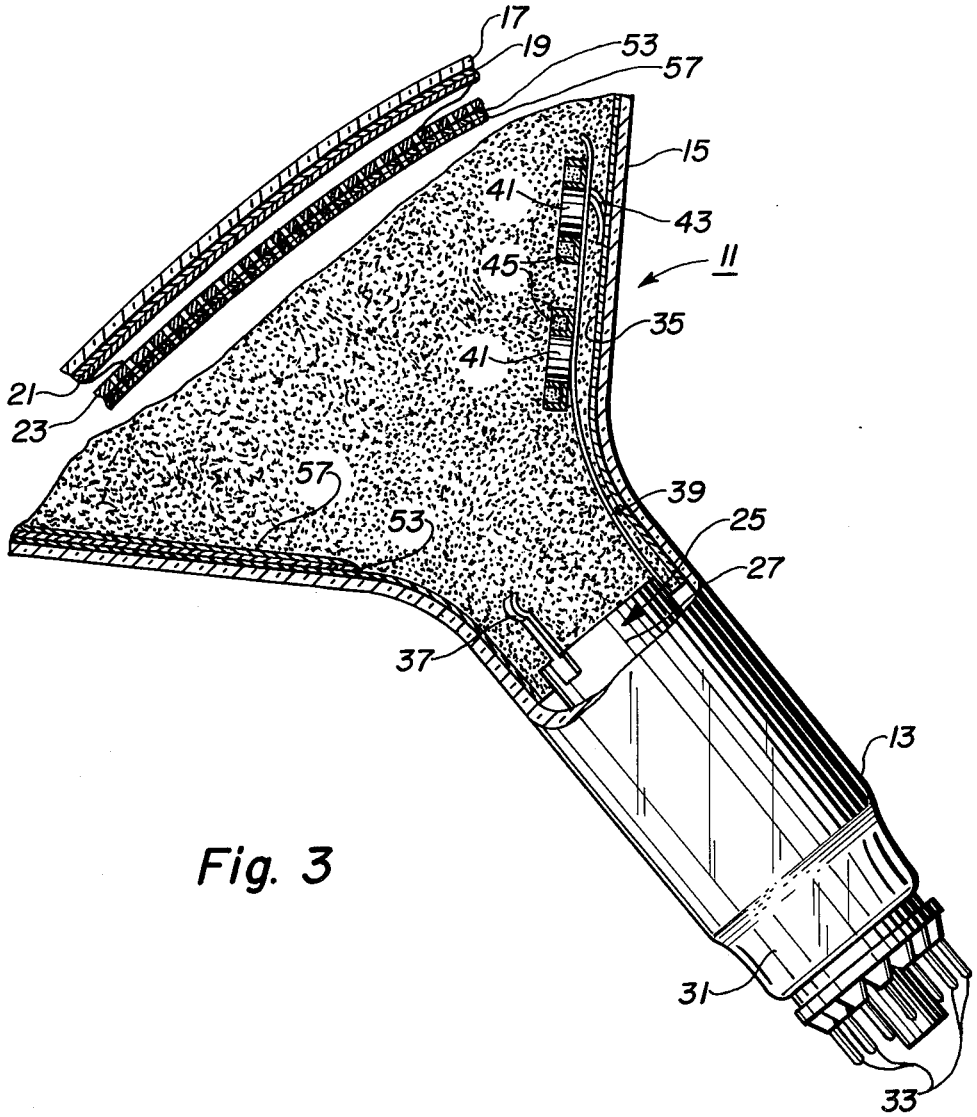
FIG. 3 is an enlarged fragmentary partially broken-away longitudinal view of a cathode-ray tube incorporating the novel tube structure having two getters.
Figure 4:
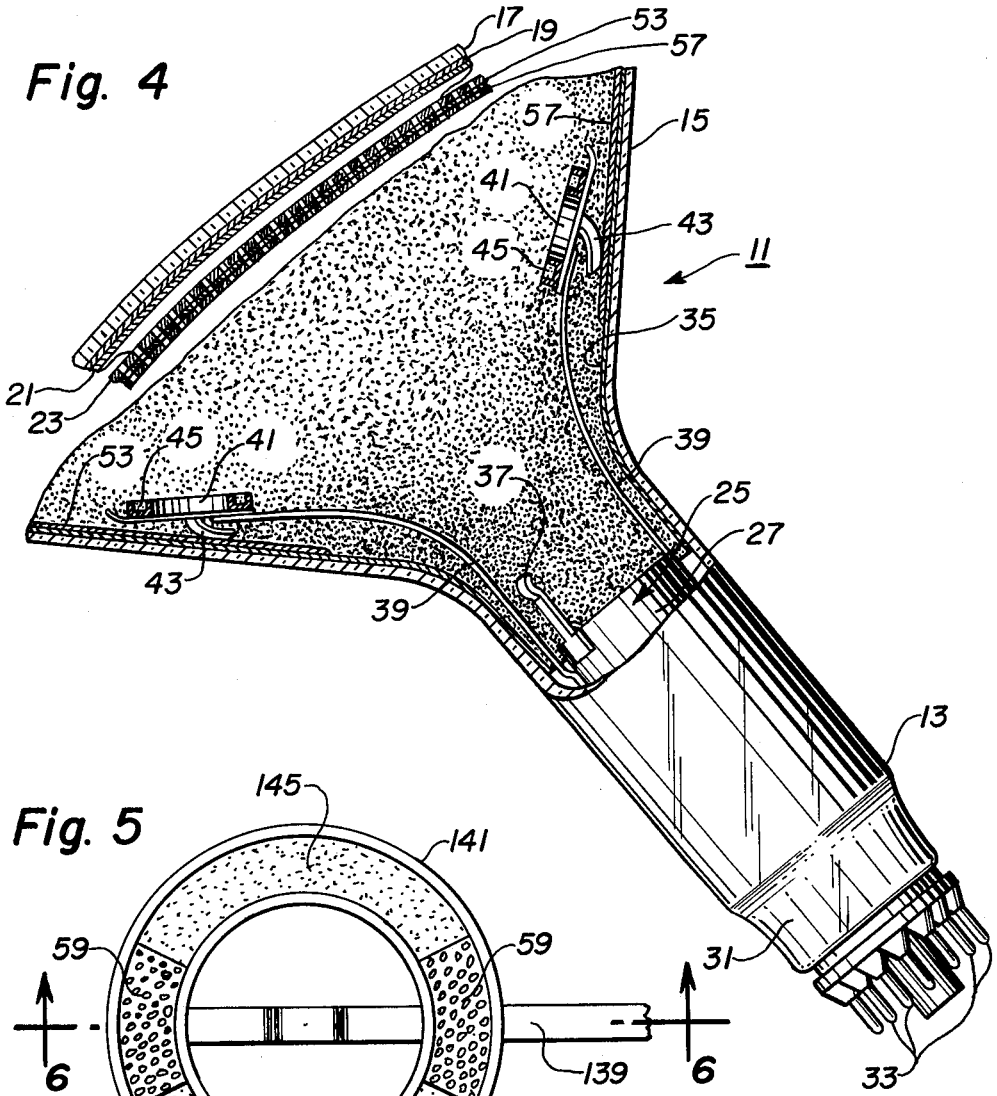
FIG. 4 is an enlarged fragmentary partially broken-away view of a cathode-ray tube incorporating another embodiment of the novel tube structure having two getters.

To ensure a sufficient quantity of barium metal at a reasonable cost, a second getter assembly comprising a second container 41 having getter material 45 therein may be added to the tube as shown in FIGS. 3 and 4. In FIG. 3, the second getter container 41 is attached to the same getter spring 39 as the first getter container. While not shown in FIG. 3, a stainless steel extension strap similar to spring 39 may also be welded to the distal end of spring 39 to secure the second getter container thereto. The spacing between the getter containers 41 should be about 25.4 mm to prevent inadvertent flashing of more than one getter at a time. As shown in FIG. 3, a second barium film 57 is deposited on the first barium film 53 on the mask 23 to render conductive any insulative particles attached to the first film 53 causing halo-blocked apertures. The second getter would be flashed immediately after initial and final test on those tubes showing halo-blocked apertures during testing.

A second embodiment of the two getter assembly tube is shown in FIG. 4. In this embodiment, a second getter spring 39, with a second getter container 41 attached thereto, is attached to a cup 27 of the mount assembly 25 opposite the first getter assembly. The getter material 45 of the second getter container 41 is flashed as described above for the structure of FIG. 3 to provide a second barium film 57 which renders conductive insulative particles attached to the first barium film 53 on the inside surface of the shadow mask 23.

Figure 5:
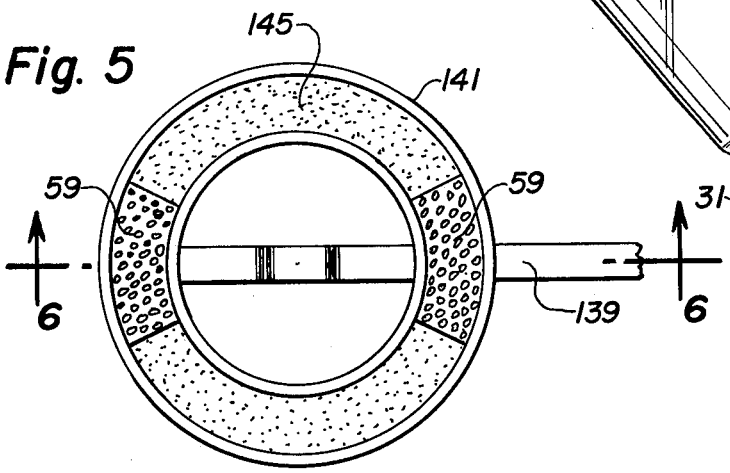
FIG. 5 is a plan view of a novel getter structure including a metal sponge reservoir.
Figure 6:
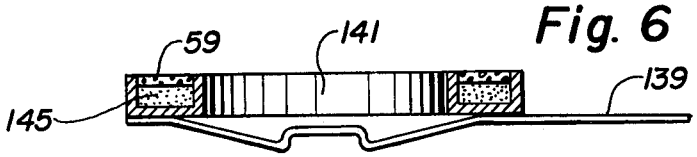
FIG. 6 is a cross-section along lines 6—6 of FIG. 5.

The getter assembly in each of the above-described embodiments may be improved by the addition of a porous member 59 to the getter container. As shown in FIGS. 5 and 6, an improved getter assembly comprises a getter spring 139, having a getter container 141 attached thereto. The getter container 141 has a ring-shaped channel with a closed base containing getter material 145. Means are provided to permit the getter spring 139 to slide freely onto the conductive funnel coating 35 without abrading the funnel coating. Runners, similar to runners 43 described above, may be attached to the bottom surface of the closed base of the container 141 or, as shown in FIG. 6, the getter spring 139 may be formed to provide a sliding contact with the funnel coating 35. The getter material 145 is preferably a mixture of nickel and a barium-aluminum alloy described above; however, any commercial getter consisting of a mixture of metals may be used.

The porous member 59 may be formed of a suitable material through which barium passes only slowly. A metal sponge is preferred although a ceramic body may be used. The porous member 59 acts as a barium metal reservoir for the subsequent endothermic evaporation of barium metal onto the insulative charged particles attached to the film of barium on the inside surface of the shadow mask 23. As shown in FIGS. 5 and 6, the porous member 59 covers only a portion of the getter material 145 and thereby provides an unimpeded path for the uncovered getter material between the getter assembly and the mask 23 for depositing the first barium film 53 on the inside surface of the mask. The porous member 59 stores some of the barium released during the exothermic getter flash. When needed, this reserve of barium can be endothermically released as described above. The porous member 59 thus functions as a reservoir of barium metal which, in addition to the barium metal residue in the getter container 41, increases the number of times barium may be endothermically released and deposited on insulative charged particles adhering to the mask thereby increasing the salvability of color picture tubes having halo-blocked apertures.

What is claimed is:

1. A method of salvaging a completed cathode-ray tube having an apertured mask and a barium aluminum alloy getter for uniformly depositing a primary barium film on an interior surface of said mask, said barium film comprising more than 70 percent of the available barium in said getter, wherein nonconductive charged particles are affixed to said primary barium film on said interior surface of said mask, the improvement comprising the step of:

reheating said getter to provide a uniformly deposited secondary barium film over said primary barium film so as to cover said particles affixed to said primary barium film.

2. In a cathode-ray tube comprising an evacuated envelope, a luminescent viewing screen within said envelope, means for producing at least one electron beam within said envelope for exciting said screen to luminescence, an apertured mask closely spaced from said screen within said envelope for selectively intercepting and transmitting portions of said electron beam, and a barium getter for coating said mask with a gas-sorbing, conductive barium film, the film on the mask having at least one insulative particle attached thereto which when impinged upon by said electron beam acquires a negative charge that deflects said transmitting portion of said beam, the improvement comprising:

a porous member through which barium passes only slowly, said porous member covering less than the entirety of said barium getter, said porous member providing a reservoir of barium, liberated during the coating of said mask, for subsequent deposition of a gas-sorbing, conductive barium film overlay on said particle, thereby rendering said particle conductive so that said transmitting portions of said beam are not deflected by said particle.

3. The tube as in claim 2, wherein said porous member comprises a permeable metal sponge.

4. The tube as in claim 2, where said porous member comprises a ceramic body.

5. A method of salvaging a completed cathode-ray tube having an apertured mask and a barium getter with a porous member through which barium passes only slowly thereby providing a reservoir of barium, said porous member covering less than the entirety of said barium getter, said getter providing a uniformly deposited primary barium film on an interior surface of said mask, wherein at least one nonconductive charged particle is affixed to said primary barium film on said interior surface of said mask, the improvement comprising the step of reheating said getter to subsequently provide, from said porous member, a uniformly deposited secondary barium film over said primary barium film so as to cover said particle affixed to said primary barium film.

* * * * *